US005912648A

United States Patent [19]

Walthers

[11] Patent Number: 5,912,648

[45] Date of Patent: Jun. 15, 1999

[54] COMPACT PATCH ANTENNA

[75] Inventor: Dwight D. Walthers, McHenry, Ill.

[73] Assignee: Motorola, Inc., Schamburg, Ill.

[21] Appl. No.: 08/744,346

[22] Filed: Nov. 7, 1996

[51] Int. Cl.[6] ..... H01Q 1/32

[52] U.S. Cl. ..... 343/713; 343/700 MS; 343/878

[58] Field of Search ..... 343/700 MS, 713, 343/715, 878, 882; H01Q 1/32

[56] References Cited

U.S. PATENT DOCUMENTS 4,692,770 9/1987 Kadokura ..... 343/715

4,916,456 4/1990 Shyu ..... 343/715

FOREIGN PATENT DOCUMENTS 2-98202 4/1990 Japan ..... H01Q 1/32

403 248-935 11/1991 Japan ..... 343/713

*Primary Examiner*—Michael C. Wimer

*Attorney, Agent, or Firm*—Daniel W. Juffernbruch

[57] ABSTRACT

A compact patch antenna having a housing (110) for holding a patch antenna hinged by hinge (130) to a planar member (120) by a clip (140). The planar member (120) is capable of hinging to an open position for use and to a closed position for storage. The clip (140) is adaptable for connection to the edge of the glass of a window of an automobile or the like.

9 Claims, 4 Drawing Sheets

COMPACT PATCH ANTENNA

BACKGROUND OF THE INVENTION

1. Technical Field of the Invention

The present invention relates to antennas and, more particularly, relates to compact antennas.

2. Related Art

Patch antennas are preferred for certain radio applications such as communications between an antenna near the ground and a satellite orbiting the earth. Patch antennas are useful in mobile applications where they can be fixed to the roof of a vehicle. The roof of a vehicle is flat, similar to the substantially planar configuration of a patch antenna element. Because the roof of a vehicle is substantially horizontal, the patch antenna has an excellent view of the satellite at all elevation angles. It is often desired, however, to removeably affix the patch antenna element is to the roof of the vehicle. It is also often desired to provide the antenna in a compact, portable structure capable of convenient storage when not used on the vehicle.

These and other objects of the invention are achieved by the compact patch antenna described and claimed herein and illustrated in the accompanying drawings.

DETAILED DESCRIPTION OF THE PREFERRED EMBODIMENTS

A patch antenna element is disposed in a housing with a planar member hinged to the housing. The planar member has a clip for gripping a vertical edge of the glass of an automobile window or the like. When the hinge is in the open position, with the planar member spaced approximately 90° from the housing, the patch antenna element is held substantially horizontal. When the antenna is not in use, the hinge can be closed, thus creating a compact structure for storage.

Figure 1:
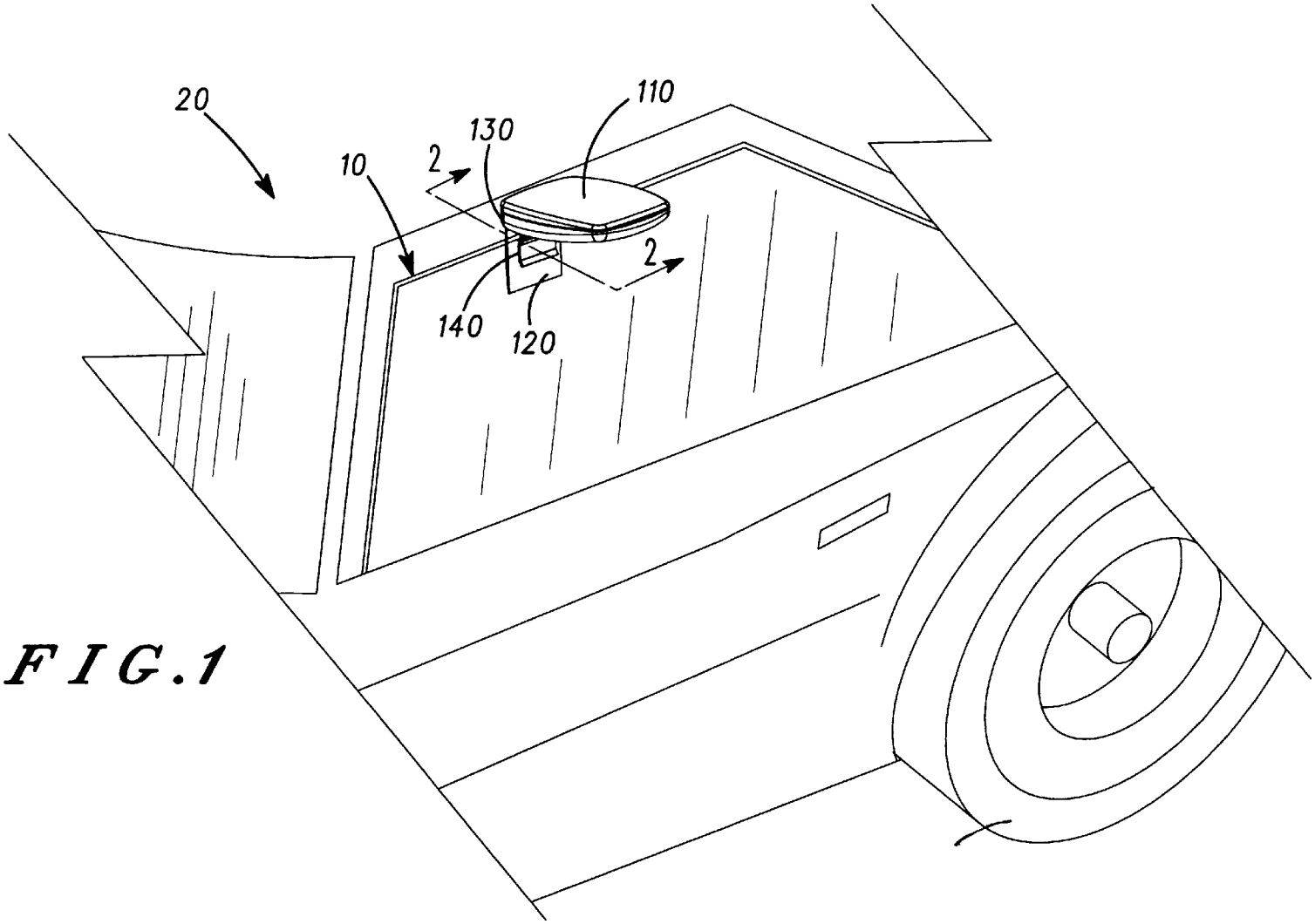
FIG. 1 illustrates a perspective view of the compact patch antenna gripping the window of an automobile.

FIG. 1 illustrates a housing 110 with a patch antenna disposed inside and a planar member 120 rotatably connected to the housing 110 by a hinge 130. The planar member 120 has a clip 140 for gripping the edge of the glass of a window 10 of an automobile 20. When the planar member 120 is clipped to the substantially vertical glass of the window 10 and the hinge 130 is in the open position, the housing 110 is spaced approximately 90° from the planar member 120 and therefore the housing 110 is substantially horizontal for communication with, for example, a satellite.

Figure 2:
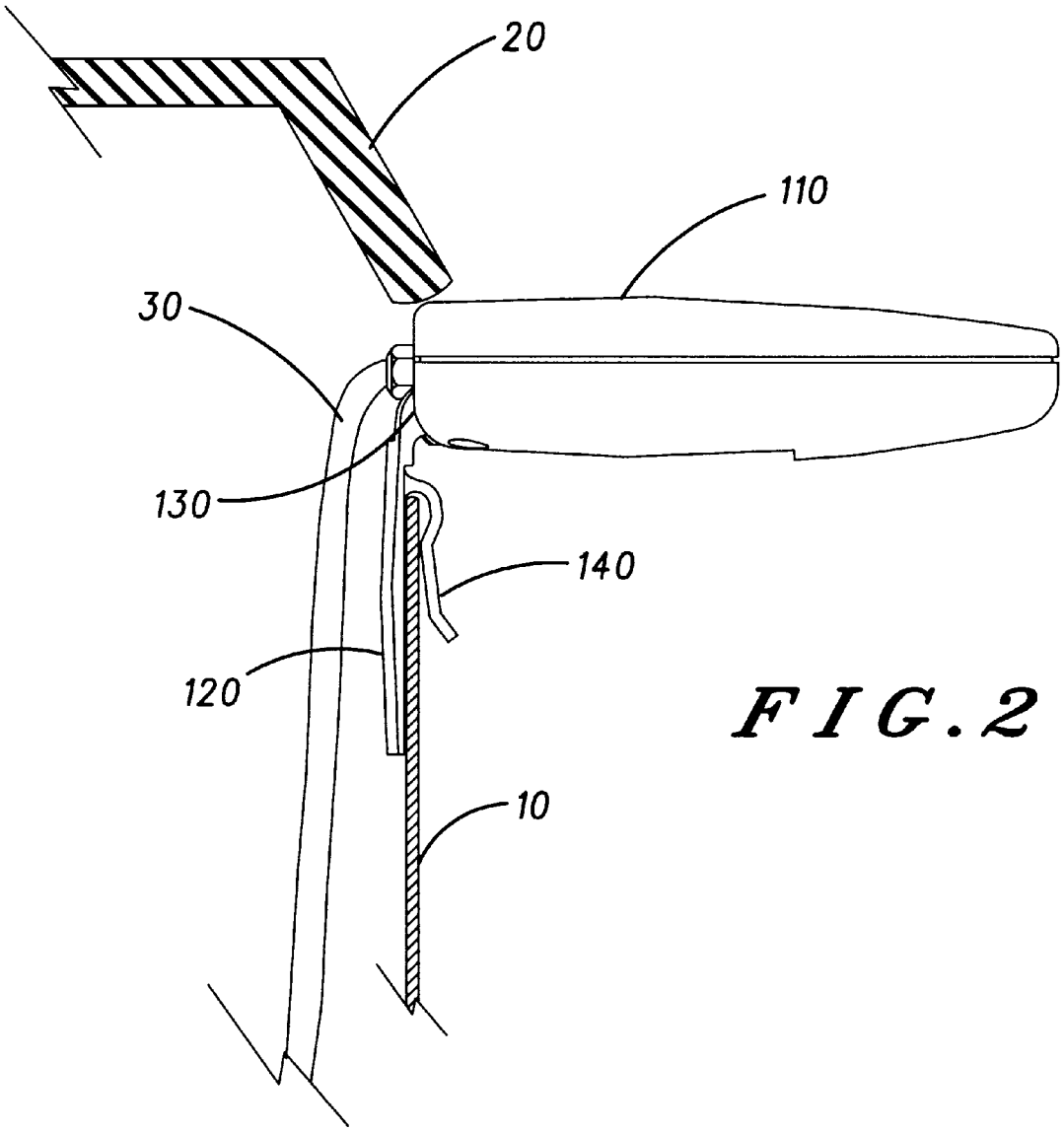
FIG. 2 illustrates a side view of the compact antenna of FIG. 1 gripping the window of an automobile.

FIG. 2 illustrates a side view along line 2—2 of the compact antenna of FIG. 1 attached to the glass of the window 10. An electrical connector is disposed at an end of the housing 110 near the hinge 130. The electrical connector allows a coaxial cable 30 to connect to the connector and pass through a crack between the glass of the window 10 and the roof of the automobile 20.

Figure 3:
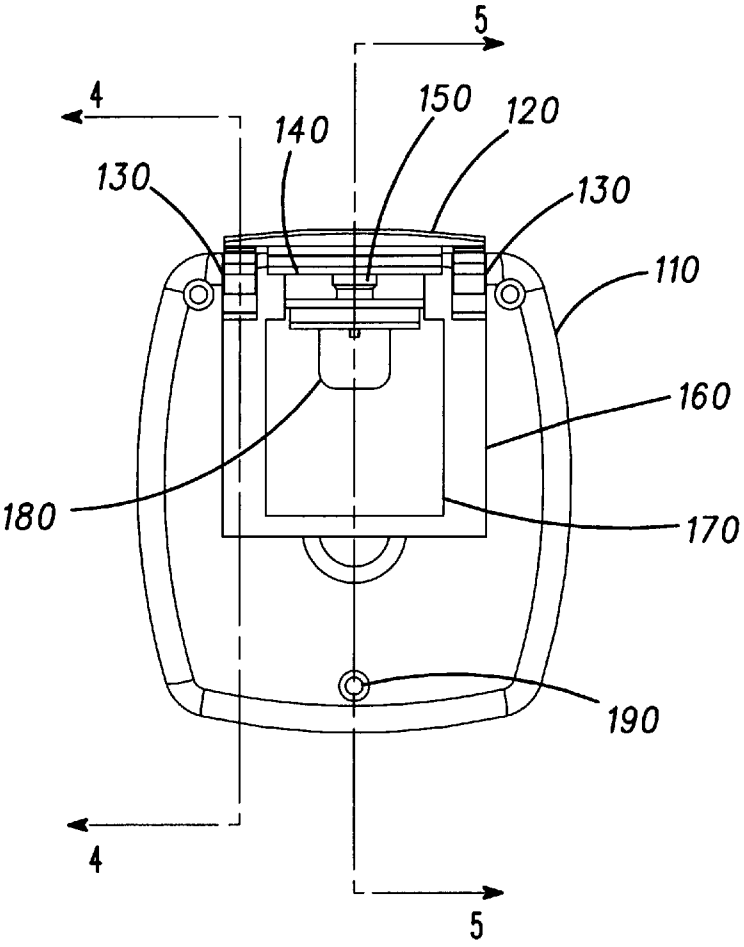
FIG. 3 illustrates a bottom plan view of the compact antenna in the open position.

FIG. 3 illustrates a bottom plan view of the compact antenna. The hinge 130 connects the housing 110 to the planar member 120 to dispose the planar member in a mating groove 160 and the clip 140 in a recess 170 when in the closed position. An opening 180 allows electrical connection of the electrical connector 150 to the patch antenna element. Holes 190 accommodate screws for connecting halves of the housing 110.

Figure 4:
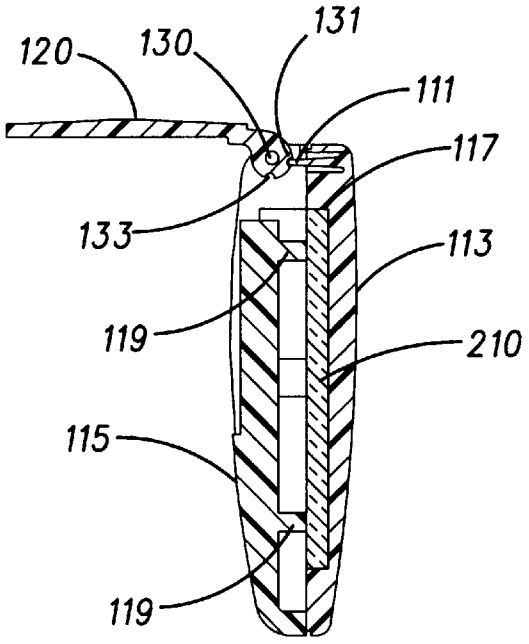
FIG. 4 illustrates a cross-section along line 4—4 of the compact antenna in the open position.

FIG. 4 illustrates a cross-sectional view along line 4—4 of the compact antenna of FIG. 3 with the planar member 120 in the open position 90° from the housing. In the preferred embodiment, the planar member 120 achieves this 90° position by hinging 90°, but could be redesigned to instead achieve the 90° position by hinging 270° in an opposite direction. The housing in the preferred embodiment is made of a top-half housing 113 and a bottom-half housing 115 for physically holding a patch antenna element 210. The top-half housing 113 has a pocket 117 and the bottom-half housing 115 has fingers 119 for securing the patch antenna element 210. The hinge 130 has detents at positions 131 and 133 for cooperating with a pin 111 of the top-half housing 113. A mechanism for holding the planar member 120 in the open position approximately 90° from the housing is important to suspend the patch antenna element 210 when in use. Although the detent is preferred for this mechanism, alternative holding or locking mechanisms are employable.

Figure 5:
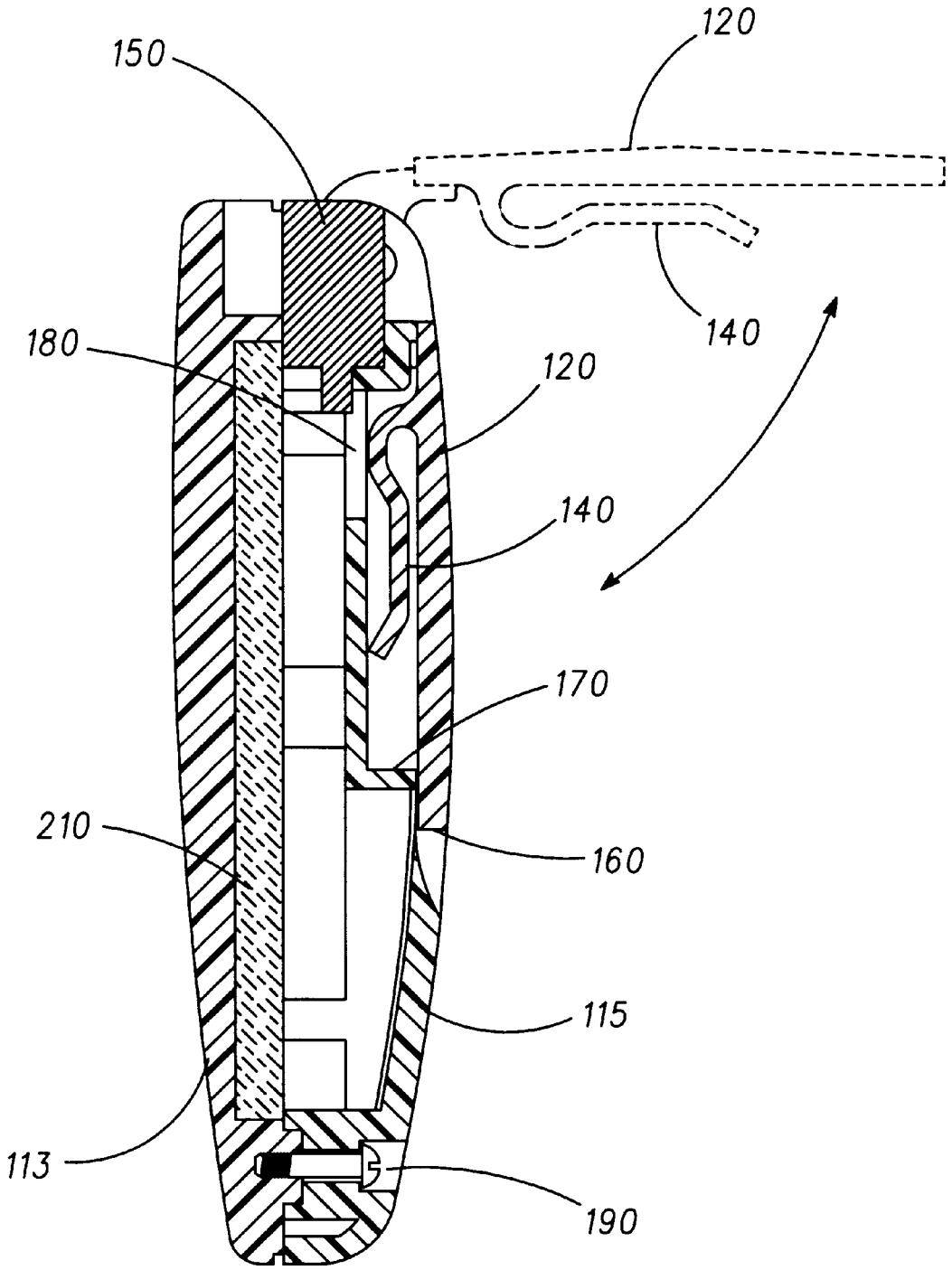
FIG. 5 illustrates a cross-section down the center line 5—5 of the compact antenna in the closed position.

FIG. 5 illustrates a cross-sectional view of the compact antenna taken along the center line 5—5 of FIG. 3, but instead with the planar member 120 in the closed position. The planar member 120 is also illustrated by dashed lines in the opened position. In the closed position, the planar member 120 mates with the edge of the groove 160 while the clip 140 is disposed within the recess 170 thereby providing a compact antenna structure. An electrical connector 150 such as a coaxial connector is electrically-connected, preferably by soldering, to the patch antenna element 210 within the cavity 180. Top-half housing 113 and bottom-half housing 115 are secured together by screws in holes 190. The housing, clip and planar member are preferably made of a plastic dielectric material having physical strength yet minimizing electromagnetic alteration of the signals on the patch antenna element 210.

Although the invention has been described and illustrated in the above description and drawings, it is understood that this description is by example only and that numerous changes and modifications, such as using microstrips along the sides of the clip or planar member to feed the signal from the patch antenna element to a connector on the interior of a vehicle, can be made by those skilled in the art without departing from the true spirit and scope of the invention.

What is claimed is:

1. A compact antenna capable of use gripped to a substantially vertically disposed holding surface, comprising:

a patch antenna element of a substantially planar configuration;

a housing configured to hold the patch antenna element disposed therein and comprising a recess;

a hinge connected to the housing and capable of radially opening from a closed position to an open position spaced approximately 90 degrees apart; and a planar member connected to the hinge for gripping the substantially vertically disposed holding surface to hold the patch antenna element substantially horizontal when the hinge is in the open position and for forming a compact structure when the hinge is in the closed position, wherein the recess is configured for mating with the planar member when the hinge is in the closed position.

2. A compact antenna according to claim 1, wherein the planar member comprises a clip for gripping the substantially vertically disposed holding surface.

3. A compact antenna according to claim 2, wherein the recess has a depth sufficient to accommodate the clip.

4. A compact antenna according to claim 2, wherein the clip is disposed on an inner surface of the planar member.

5. A compact antenna according to claim 2, wherein the clip is sized to mate with a thickness of an edge of a piece of automotive window glass which forms the substantially vertically disposed holding surface.

6. A compact antenna according to claim 1, wherein the hinge comprises a locking device to lock the hinge in at least the open position.

7. A compact antenna according to claim 6, wherein the locking device comprises a detent.

8. A compact antenna according to claim 1, further comprising an electrical connector disposed in the housing and operatively coupled to the patch antenna element.

9. A compact antenna according to claim 1, wherein the substantially vertically disposed holding surface is an upper edge of vertical window glass on a vehicle.

* * * * *